US007104904B1

(12) United States Patent
Gait

(10) Patent No.: US 7,104,904 B1
(45) Date of Patent: Sep. 12, 2006

(54) LACROSSE HEAD

(75) Inventor: Paul Gait, Syracuse, NY (US)

(73) Assignee: J. deBeer & Son, Inc., Albany, NY (US)

( * ) Notice: Subject to any disclaimer, the term of this patent is extended or adjusted under 35 U.S.C. 154(b) by 29 days.

(21) Appl. No.: 10/807,925

(22) Filed: Mar. 24, 2004

(51) Int. Cl.
*A63B 59/02* (2006.01)
*A63B 65/12* (2006.01)

(52) U.S. Cl. ..... 473/513; D21/724

(58) Field of Classification Search ..... 473/513, 473/512, 505; D21/724
See application file for complete search history.

(56) References Cited

U.S. PATENT DOCUMENTS

| | | | | |
|---|---|---|---|---|
| 891,813 | A | 6/1908 | Ceel | |
| 1,459,389 | A | 6/1923 | Brown | |
| 1,866,158 | A | 7/1932 | Goodwin | |
| 1,917,236 | A | 7/1933 | Bloomstrand | |
| 2,029,790 | A | 2/1936 | Philipp | |
| 2,039,138 | A | 4/1936 | Auer | |
| 2,075,372 | A * | 3/1937 | Taylor | 473/513 |
| 2,142,527 | A | 1/1939 | Pool | |
| 2,508,519 | A | 5/1950 | Jay | |
| 2,710,753 | A | 6/1955 | Lockwood | |
| D210,543 | S | 3/1968 | Nakayama | |
| 3,473,806 | A | 10/1969 | Patterson | |
| 3,507,495 | A | 4/1970 | Tucker | |
| 3,591,178 | A | 7/1971 | Milligan | |
| 3,702,702 | A | 11/1972 | Hoult | |
| 3,822,062 | A | 7/1974 | Tucker | |
| D236,737 | S | 9/1975 | Brine | |
| 3,905,088 | A | 9/1975 | Tucker | |
| 3,910,578 | A | 10/1975 | Brine, Jr. | |
| 4,022,477 | A | 5/1977 | Pool | |
| 4,034,984 | A | 7/1977 | Crawford | |
| 4,037,841 | A | 7/1977 | Lewis, Jr. | |
| 4,049,273 | A | 9/1977 | Pool | |
| 4,097,046 | A | 6/1978 | Friant | |
| D248,679 | S | 7/1978 | Rule | |
| 4,138,111 | A | 2/1979 | Rule | |
| 4,153,251 | A | 5/1979 | Pond | |
| D252,167 | S | 6/1979 | Ahlenfeld | |
| 4,206,918 | A | 6/1980 | Lewis, Jr. | |
| 4,270,756 | A | 6/1981 | Ahlenfeld | |

(Continued)

FOREIGN PATENT DOCUMENTS

| | | |
|---|---|---|
| CA | 342045 | 10/1932 |

(Continued)

*Primary Examiner*—Stephen Blau
*Assistant Examiner*—M. Chambers
(74) *Attorney, Agent, or Firm*—Waddey & Patterson; Phillip E. Walker; Edward D. Lanquist, Jr.

(57) ABSTRACT

The present invention discloses lacrosse head having a throat for receiving a handle, a scoop distal from the throat, a pair of sidewalls extending from the throat to the scoop, and a ball stop adjacent the throat. A pair of floating ribs corresponding to each of the pair of sidewalls is provided. Each of the floating ribs has a first end and a second end separated by a middle portion wherein the first end is joined proximal the throat and the second end is joined proximal the side wall and a segment of the middle portion is not attached to the sidewall. The socket is provided with an inner perimeter and outer perimeter. The outer perimeter has a proximal end proximal a mouth for receiving the lacrosse handle and a distal end distal the proximal end, the distal end being larger than the proximal end. The outer perimeter is substantially smooth.

11 Claims, 2 Drawing Sheets

U.S. PATENT DOCUMENTS

| | | | |
|---|---|---|---|
| D263,248 | S | 3/1982 | Brine, Jr. |
| D263,249 | S | 3/1982 | Rule |
| D265,845 | S | 8/1982 | Brine, Jr. |
| 4,358,117 | A | 11/1982 | Deutsch |
| D273,601 | S | 4/1984 | Lewis, Jr. |
| D277,691 | S | 2/1985 | Rule |
| D286,666 | S | 11/1986 | Brine, Jr. |
| D286,803 | S | 11/1986 | Brine, Jr. |
| 4,657,260 | A | 4/1987 | Brine, Jr. |
| 4,739,994 | A | 4/1988 | Lewis, Jr. |
| D297,963 | S | 10/1988 | Tucker |
| 4,861,042 | A | 8/1989 | Trettin |
| 4,938,480 | A | 7/1990 | Lods |
| 4,940,243 | A | 7/1990 | Tucker |
| D318,509 | S | 7/1991 | Naumburg, Jr. |
| 5,035,434 | A | 7/1991 | Taylor |
| 5,037,112 | A | 8/1991 | Brine, III |
| 5,048,843 | A | 9/1991 | Dorfi |
| 5,054,790 | A | 10/1991 | Brine, III |
| 5,067,726 | A | 11/1991 | Brine, III |
| 5,080,372 | A | 1/1992 | Brine, III |
| 5,082,290 | A | 1/1992 | Tucker |
| D331,086 | S | 11/1992 | Brine, III |
| 5,178,397 | A | 1/1993 | Brine, Jr. |
| 5,269,532 | A | 12/1993 | Tucker |
| D350,173 | S | 8/1994 | Tucker |
| D350,174 | S | 8/1994 | Tucker |
| D350,999 | S | 9/1994 | Chen |
| 5,425,541 | A | 6/1995 | Ambros |
| 5,494,297 | A | 2/1996 | MacNeil |
| 5,566,947 | A | 10/1996 | Tucker |
| 5,568,925 | A | 10/1996 | Morrow |
| D376,183 | S | 12/1996 | Morrow |
| 5,651,549 | A | 7/1997 | Dill |
| 5,651,744 | A | 7/1997 | Millon |
| 5,674,140 | A | 10/1997 | Tucker |
| 5,685,791 | A | 11/1997 | Feeney |
| 5,935,026 | A | 8/1999 | Dill |
| 5,938,550 | A | 8/1999 | Hexemer |
| 5,957,791 | A | 9/1999 | Nichols |
| 5,967,912 | A | 10/1999 | Hexemer |
| 6,066,056 | A | 5/2000 | Morrow |
| 6,186,912 | B1 | 2/2001 | Gait |
| 6,213,901 | B1 | 4/2001 | Collinson |
| D444,834 | S | 7/2001 | Tucker, Sr. |
| D445,472 | S | 7/2001 | Tucker |
| 6,283,879 | B1 | 9/2001 | Eden |
| 6,447,410 | B1 | 9/2002 | Crawford |
| RE37,894 | E | 10/2002 | MacNeil |
| 6,500,079 | B1 | 12/2002 | Tucker |
| 6,506,132 | B1 | 1/2003 | Brine, III |
| 6,520,875 | B1 | 2/2003 | Crawford |
| 6,533,686 | B1 | 3/2003 | LeMire |
| D474,823 | S | 5/2003 | Kohler |
| 6,561,932 | B1 | 5/2003 | Morrow |
| RE38,216 | E | 8/2003 | Morrow |
| 6,902,501 | B1 * | 6/2005 | Morrow et al. ..... 473/513 |
| 6,921,347 | B1 * | 7/2005 | Morrow et al. ..... 473/513 |
| 2001/0044347 | A1 | 11/2001 | Crawford |
| 2002/0061374 | A1 | 5/2002 | O'Brien |
| 2002/0107094 | A1 | 8/2002 | LeMire |
| 2002/0160865 | A1 | 10/2002 | Brine, III |
| 2002/0173388 | A1 | 11/2002 | Morrow |
| 2002/0173389 | A1 | 11/2002 | Morrow |
| 2002/0198070 | A1 | 12/2002 | Tucker |
| 2004/0002398 | A1 | 1/2004 | Morrow |

FOREIGN PATENT DOCUMENTS

| | | |
|---|---|---|
| CA | 870192 | 5/1971 |
| CA | 880467 | 9/1971 |
| CA | 896691 | 3/1972 |
| CA | 903285 | 5/1976 |
| CA | 989892 | 5/1976 |
| CA | 1077989 | 5/1980 |
| CA | 1109091 | 9/1981 |
| CA | 1215406 | 12/1986 |
| CA | 1222853 | 6/1987 |
| CA | 1273662 | 9/1990 |
| CA | 1317610 | 5/1993 |
| CA | 2112721 | 7/1994 |
| CA | 2140080 | 2/1996 |
| CA | 2322830 | 9/1999 |
| CA | 2326206 | 5/2001 |
| CA | 2183393 | 8/2001 |
| CA | 2342273 | 9/2001 |
| CA | 2266981 | 1/2002 |
| CA | 2359858 | 4/2002 |

* cited by examiner

LACROSSE HEAD

A portion of the disclosure of this patent document contains material that is subject to copyright protection. The copyright owner has no objection to the facsimile reproduction by anyone of the patent document or the patent disclosure, as it appears in the U.S. Patent and Trademark Office patent file or records, but otherwise reserves all copyright rights whatsoever.

BACKGROUND OF THE INVENTION

The present invention relates generally to an implement used for playing lacrosse and more particularly, to a lacrosse head.

It will be appreciated by those of ordinary skill in the art that lacrosse is a fast growing sport. It will further be appreciated by those of ordinary skill in the art that lacrosse heads are essential to playing the game. A head is a basket that attaches to the end of a handle. The lacrosse head is usually molded from duPont Xytel® brand nylon. The lacrosse head has an open or upper side for catching and discharging the ball and a lower side to which a net or pocket is attached for holding a ball. A lacrosse head has a throat section having a socket for receiving a handle and a ball stop. To the ball stop there is attached a pair of sidewalls. Ribs are provided on either in interior or exterior of the sidewalls for strength or to vary pocket size. However, these ribs are attached along the majority of their length to the head. The sidewalls are joined distal from the ball stop by a lip or scoop. A socket is provided to receive a handle. The socket has an inner perimeter that is multi-sided and of a shape to mate with a similarly-shaped handle. The prior art external perimeter of the socket tends to be inconsistent in that it is shaped like the internal perimeter or it melds into the structure of the very angular lacrosse head.

BRIEF SUMMARY OF THE INVENTION

The present invention discloses a lacrosse head having a throat for receiving a handle, a scoop distal from the throat, a pair of sidewalls extending from the throat to the scoop, and a ball stop adjacent the throat. A pair of floating ribs corresponding to each of the pair of sidewalls is provided. Each of the floating ribs has a first end and a second end separated by a middle portion wherein the first end is joined proximal the throat and the second end is joined proximal the side wall and a segment of the middle portion is not attached to the sidewall. The socket is provided with an inner perimeter and outer perimeter. The outer perimeter has a proximal end proximal a mouth for receiving the lacrosse handle and a distal end distal the proximal end, the distal end being larger than the proximal end. The outer perimeter is substantially smooth.

Accordingly, one object of the present invention is to provide a lacrosse head having a floating rib.

Another object of the present invention is to provide a socket having a smooth outer perimeter.

Another object of the present invention is to strengthen the head without adding much weight.

Another object of the present invention is to provide a head in which the catching area is enlarged without added much weight.

Another object of the present invention is to provide a head in which the height is increased without enlarging the sidewalls.

Another object of the present invention is to provide a lacrosse head having a socket that can be more easily turned in the top hand of the user.

Another object of the present invention is to provide a socket having a ridge that improves the user's ability to thrust.

DETAILED DESCRIPTION OF THE INVENTION

Figure 1:
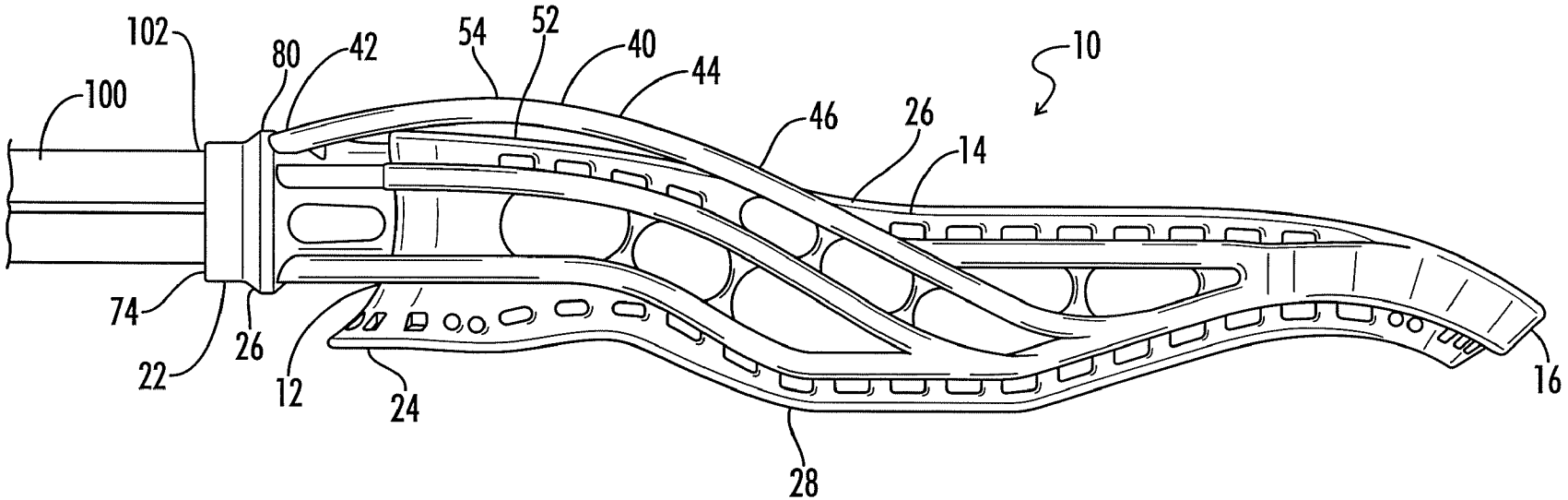
FIG. 1 is a side view the first embodiment of the present invention.
Figure 2:
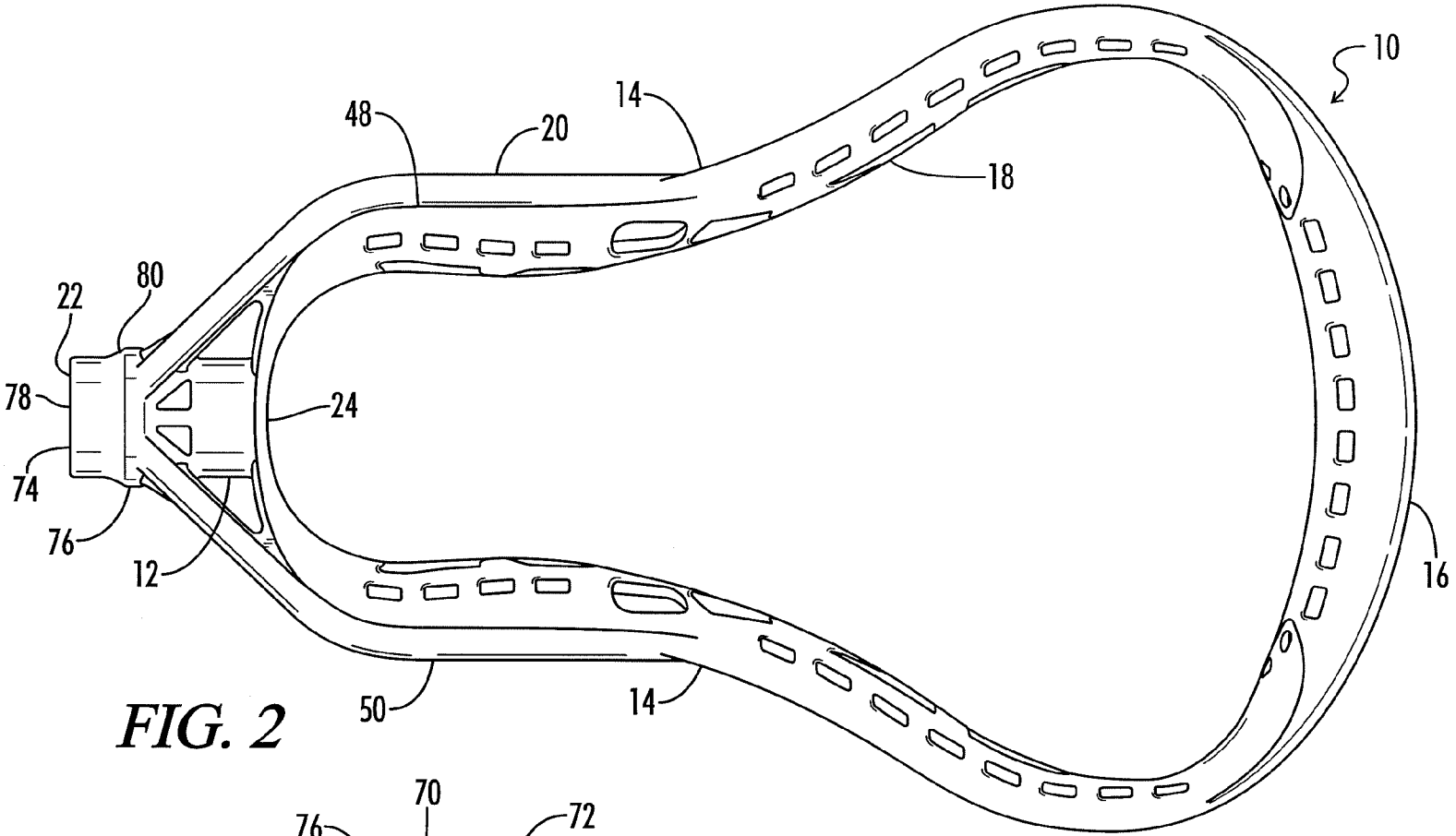
FIG. 2 is a side view of the first embodiment of the present invention.
Figure 3:
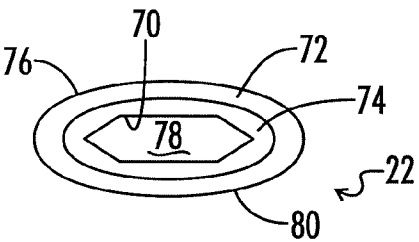
FIG. 3 is an end view of another embodiment of the present invention.

Referring now to FIGS. 1–3 there is shown generally at 10, the preferred embodiment of the lacrosse head of the present invention. Lacrosse head 10 has throat 12 joined to a pair of side walls 14. Scoop 16 is joined to side walls 14 distal from throat 12. Throat 12 consists of socket 22 for receiving a handle 100 and ball stop 24. Lacrosse head 10 is provided with inner edge 18 and outer edge 20. Lacrosse head 10 has upper or open portion 26 and lower or net receiving portion 28. Between upper portion 26 and lower portion 28 is middle portion 30.

In one preferred embodiment, a floating rib 40 is provided. In the preferred embodiment, the floating rib 40 has a first end 40 and a second end 46 separated by a middle portion 44. In the preferred embodiment, the first end 42 is joined to the head 10 preferably along the throat 12 and the second end 46 is joined to the head preferably along the upper portion 26 of the sidewall 14 while the middle portion 44 or at least a portion thereof does not engage nor is attached to the head 10. By being separate from the sidewall 14, the floating rib 40 at its apex 54 raises the effective height of the sidewall 14 without raising the true height of the sidewall 14. Further, in the preferred embodiment, the distance between the inner portions 48 of the floating ribs 40 is greater than the distance between the inner edges 18 of the sidewalls 14 immediately below the floating ribs 40. In this manner, the catching area of the lacrosse head 10 is greater at the top without widening the sidewalls 14. Further, the space 52 under the floating rib 40 represents a void where sidewall material would otherwise be. Therefore, the floating rib 40 allows the head 10 to have a larger catching area, stronger sidewalls 14, and be taller without adding the weight that would be added if the floating rib 40 was part of the sidewall 14.

Referring again to FIGS. 1–3 there is shown generally at 10, the preferred embodiment of the lacrosse head of the present invention. Lacrosse head 10 has throat 12 joined to a pair of side walls 14. Scoop 16 is joined to side walls 14 distal from throat 12. Throat 12 consists of socket 22 for receiving a handle 100 and ball stop 24. Lacrosse head 10 is provided with inner edge 18 and outer edge 20. Lacrosse head 10 has upper or open portion 26 and lower or net receiving portion 28. Socket 22 has inner perimeter 70 and outer perimeter 72. Inner perimeter 70 is preferably shaped to effectively receive and engage the handle 100. Outer perimeter 72 is preferably circular or ovular in shape and substantially smooth to allow a portion of users top hand to slide across the surface of outer perimeter 72. Preferably, outer perimeter 72 has proximal end or portion 74 closest to the mouth 78 into which the handle 100 is placed and distal end or portion 76 which is closest to the throat 12 or ball stop 24. In the preferred embodiment, the diameter of the outer perimeter 72 is greater closest to distal portion 76 than closest to proximal portion 74. Preferably, a ridge 80 is provided proximal to distal portion 76 against which the user's top hand may rest to assist in the thrust of the lacrosse stick 102. In the preferred embodiment, the shape of the outer perimeter 72 is round with the diameter of the proximal end 74 being less than the diameter of the distal portion 76. However, if the outer perimeter is ovular in shape, the length of the proximal end 74 along any axis is less than the length taken along a similar axis of the distal portion 76.

FIG. 3 shows an ovular socket 22. Again, inner perimeter 70 is shaped to receive a handle in mouth 80. Outer perimeter 72 is shaped in this instance as an oval. Proximal portion 74 is smaller than distal portion 76 along any similar axis of measurement. Distal portion 76 rises to ridge 80.

Thus, although there have been described particular embodiments of the present invention of a new and useful Lacrosse Head, it is not intended that such references be construed as limitations upon the scope of this invention except as set forth in the following claims.

What is claimed is:

1. A lacrosse head comprising:

a throat for receiving a handle;

a scoop distal from the throat;

a pair of sidewalls extending from the throat to the scoop each of the sidewalls having an upper portion and a lower portion;

a ball stop adjacent the throat; and a pair of floating ribs corresponding to each of the pair of sidewalls, each of the floating ribs having a first end and a second end separated by a middle portion wherein the first end is joined proximal the throat and the second end is joined proximal the side wall and the middle portion is not attached to the sidewall between the first end and second end, each of the middle portions rising above the throat distal from the upper portion wherein the floating rib creates a space between the floating rib and the upper portion.

2. The lacrosse head of claim 1 wherein the middle portion is attached to neither the sidewall nor the throat.

3. The lacrosse head of claim 1 wherein:

each of the sidewalls having an inner edge; and the floating ribs having an inner portion, wherein the distance between the inner portions is greater than the distance between the inner edges.

4. The lacrosse head of claim 3 wherein each of the floating ribs includes an apex, the apex is further from the lower portion than the upper portion, and the distance between the inner portions is greater than the distance between the inner edges at the apex.

5. The lacrosse head of claim 3 wherein the distance between the inner portions of the floating ribs is greater than the distance between the inner edges of the sidewalls between the ball stop and the second ends.

6. A floating rib attached to a lacrosse head having a throat for receiving a handle, a scoop distal from the throat, a pair of sidewalls extending from the throat to the scoop, each of the sidewalls having a upper portion and a lower portion; and a ball stop adjacent the throat, the floating rib comprising a first end and a second end joined by a middle portion, the first end and the second end joined to the lacrosse head, and the middle portion being unattached to the lacrosse head between the first second end and wherein the middle portion of the floating rib creates an open space between the floating rib and the lacrosse head.

7. The floating rib of claim 6 wherein the floating rib is positioned substantially parallel to one of the side walls.

8. The floating rib of claim 6 further comprising an apex positioned a greater distance from the lower portion of the sidewall than the upper portion of the sidewall is from the lower portion of the sidewall.

9. A pair of floating ribs attached to a lacrosse head having a throat for receiving a handle, a scoop distal from the throat, a pair of sidewalls each including an inner edge and extending from the throat to the scoop, and a ball stop adjacent the throat, each of the floating ribs comprising a first end and a second end joined by a middle portion and an inner portion, the first end and the second end joined to the lacrosse head, and a segment of the middle portion unattached to the lacrosse head and having an apex positioned a greater distance from a lower portion of the sidewall than from an upper portion of the sidewall, wherein the distance between the inner portions is greater than the distance between the inner edges at the apex wherein the middle portions of the floating ribs create an open space between the floating ribs and the lacrosse head.

10. The floating ribs of claim 9 further comprising the middle portion unattached to the lacrosse head.

11. The floating ribs of claim 9 wherein the distance between the inner portions is greater than the distance between the inner edges alone the middle portion.

* * * * *